US005441321A

United States Patent [19]

Karpisek

[11] Patent Number: 5,441,321

[45] Date of Patent: Aug. 15, 1995

[54] OPENABLE CONTAINER BASE

[76] Inventor: Ladislav S. Karpisek, 86 Woodfield Boulevarde, Caringbah, New South Wales 2229, Australia

[21] Appl. No.: 50,304

[22] PCT Filed: Sep. 2, 1992

[86] PCT No.: PCT/AU92/00460

§ 371 Date: Jun. 21, 1993

§ 102(e) Date: Jun. 21, 1993

[87] PCT Pub. No.: WO93/04953

PCT Pub. Date: Mar. 18, 1993

[30] Foreign Application Priority Data

Sep. 2, 1991 [AU] Australia ..... PK8141

[51] Int. Cl.[6] ..... B65D 88/28; B65D 88/52

[52] U.S. Cl. ..... 294/68.21; 222/185.1; 222/556

[58] Field of Search ..... 294/68.1–68.22, 294/68.3, 68.24; 220/1.5, 4.28, 4.31, 4.32; 222/185, 556; 414/378, 387, 391, 414, 422

[56] References Cited

U.S. PATENT DOCUMENTS

| | | | |
|---|---|---|---|
| 603,858 | 5/1898 | Rakov | 294/68.24 X |
| 834,305 | 10/1906 | Kozora | 294/68.22 |
| 948,365 | 2/1910 | Zoller | 294/68.24 |
| 2,599,618 | 6/1952 | Dempster | 294/68.21 |
| 2,802,603 | 8/1957 | McCray | 222/185 |
| 2,973,886 | 3/1961 | Elgaard | 294/68.21 |
| 3,152,824 | 10/1964 | Bolling et al. | 294/68.21 X |
| 3,161,300 | 12/1964 | Johansson | 294/68.21 X |
| 3,219,381 | 11/1965 | Cox et al. | 294/68.21 |
| 3,719,296 | 3/1973 | Larson | 294/68.21 X |
| 4,423,831 | 1/1984 | Sipley | 294/68.21 X |

FOREIGN PATENT DOCUMENTS

| | | |
|---|---|---|
| 137373 | 6/1948 | Australia . |
| 142819 | 4/1949 | Australia . |
| 2534227 | 4/1984 | France . |
| 1152888 | 4/1985 | U.S.S.R. . |
| 1253888 | 2/1986 | U.S.S.R. . |
| 1386531 | 4/1988 | U.S.S.R. . |

*Primary Examiner*—Johnny D. Cherry
*Attorney, Agent, or Firm*—Edwin D. Schindler

[57] ABSTRACT

A container base (1) including a rectangular ring frame (5) with four sides defining an opening (5*a*) through the base frame, a base bottom (1*a*, 2), a pivot connection (6) between the ring frame (5) and the base bottom (1*a*, 2) and latches (50) releaseably couple the ring frame (5) and the base bottom (1*a*, 5) together. Each side (7) of the ring frame (5) has slots (8) for engagement by hooks (22) on four wall panels (21) so that the wall panels (22) can be coupled to the base (1).

6 Claims, 6 Drawing Sheets

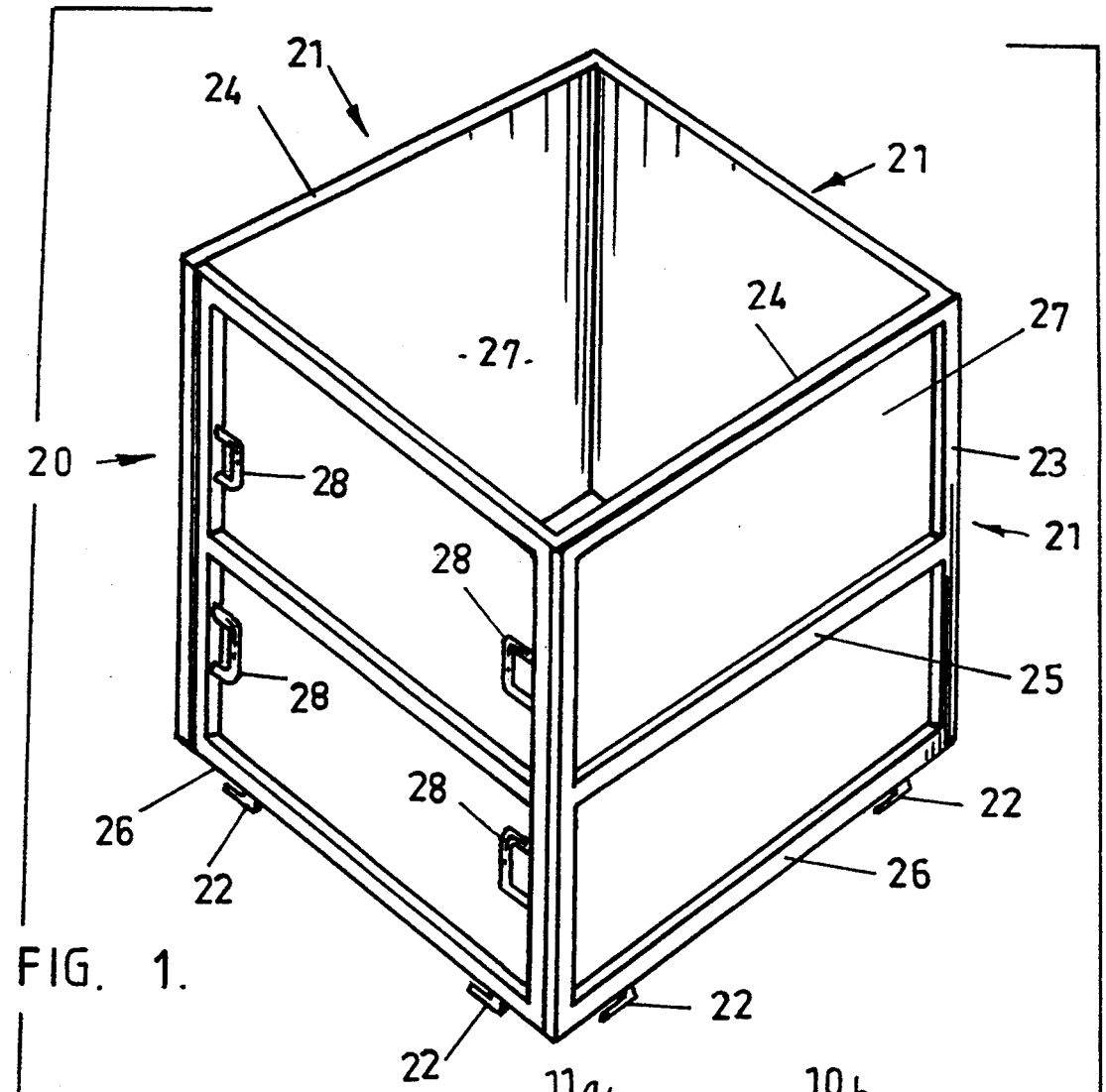
FIG. 1.
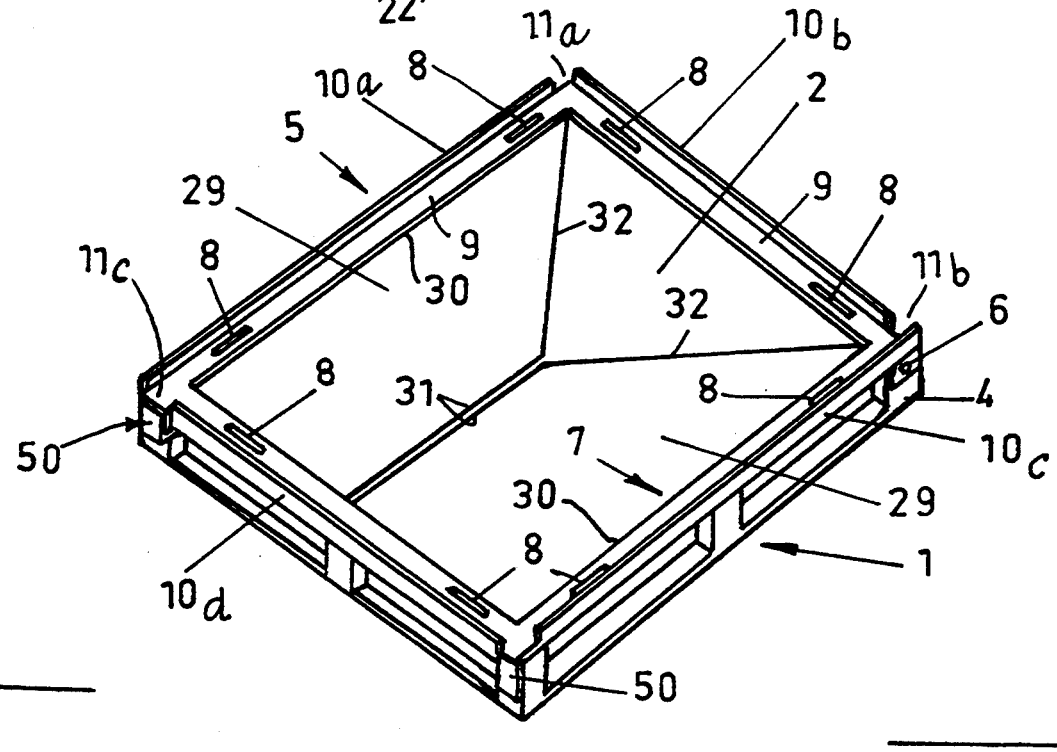

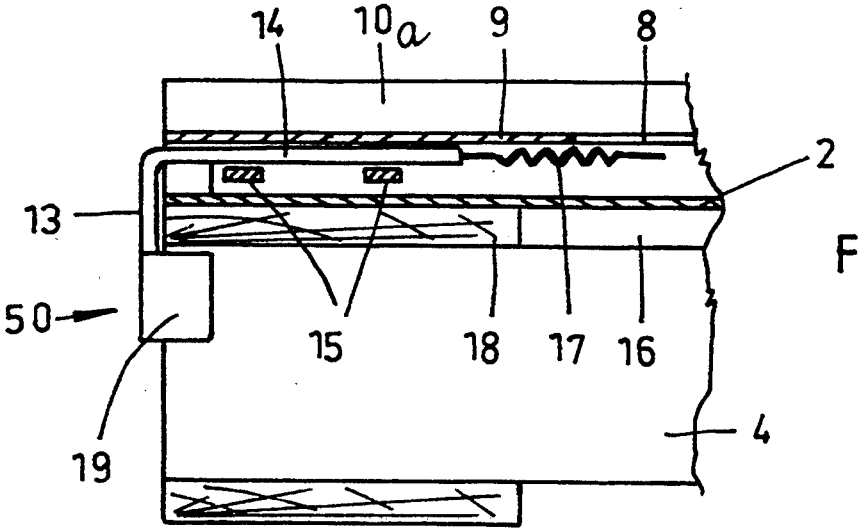
FIG. 3.
FIG. 4.
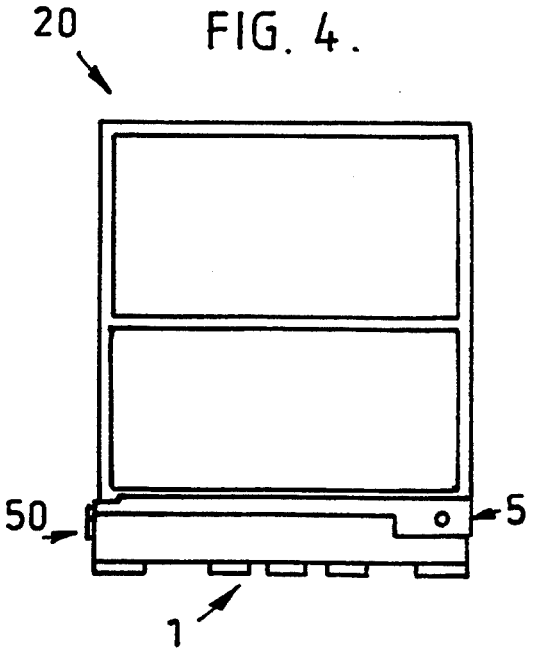
FIG. 5.
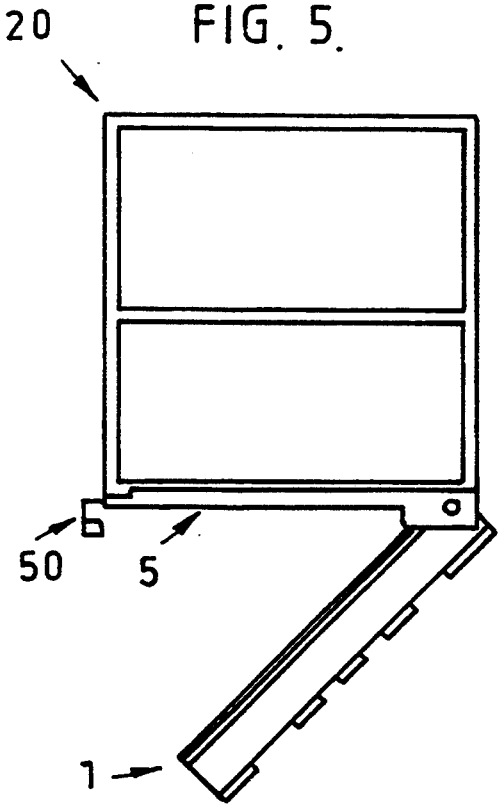

OPENABLE CONTAINER BASE

This invention relates to a base for a container whereby the flowable contents of the container can be discharged.

It is a requirement of many containers that the contents be readily bottom discharged by gravity. Such containers are particularly useful for the carriage of bulk dry materials of a discrete nature. To this time, devices have been provided which allow side discharge through a side of the container and bottom discharge through a funnel in the base of the container or attached thereto.

This invention provides a container base (hereinafter for convenience called a base) which has many advantages over known arrangements for the discharge of flowable materials from containers. Generally, the base includes a four sided base frame defining an opening and a pivotally connected base bottom which can be pivoted relative to the base frame as required to cover and uncover the opening. In a preferred embodiment there are flaps connected to the base frame which deploy as the base bottom pivots with respect to the base frame to provide directional control of the discharge of material from the container of which the base forms part.

The base may be for or form part of a container which is preferably but not necessarily of the type which comprises four interconnectable wall panels which can be mounted on and removed from the base in a simple manner. This form of container because of its collapsible nature has great attraction as a container for repeated use in the transport of material from a place of manufacture to a place of use where the contents can be readily discharged through the container base.

Broadly, the invention can be said to provide a container base for or forming part of a container, where the base includes a rectangular base frame with four sides defining an opening through the base frame, a base bottom which is pivotally connected to the base frame at or closely adjacent one side thereof and latch means to releaseably retain the base bottom in covering relationship with the opening through the base frame.

Figure 2:
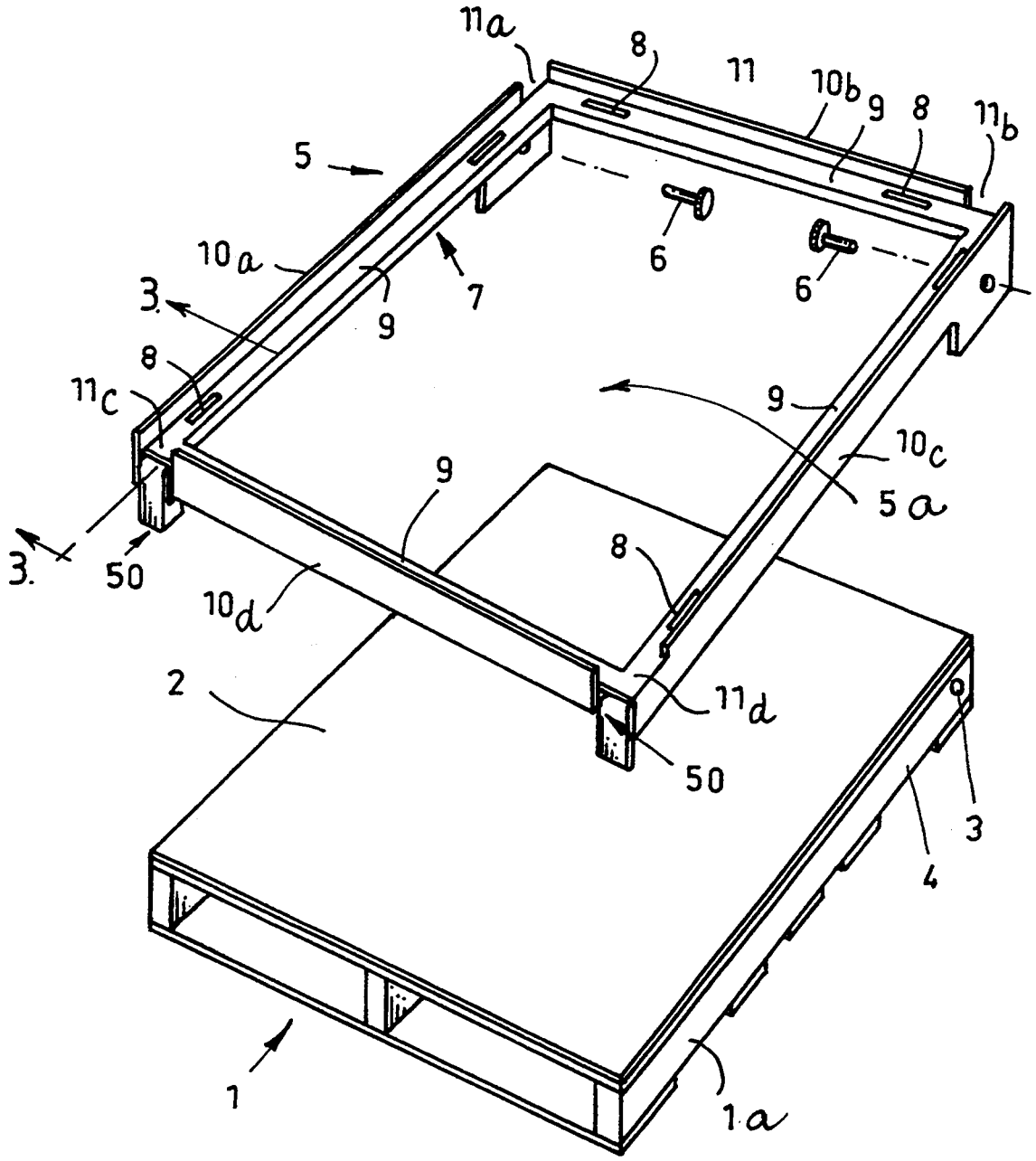
Figure 6:
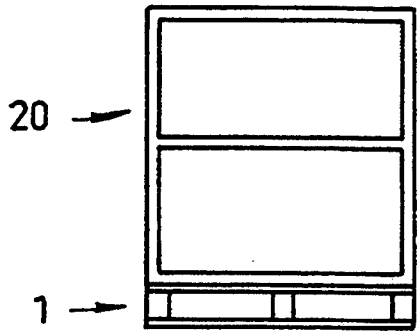
Figure 7:
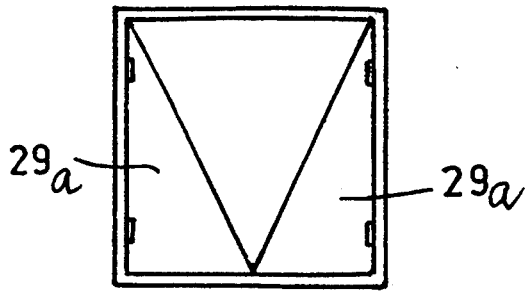
Figure 8:
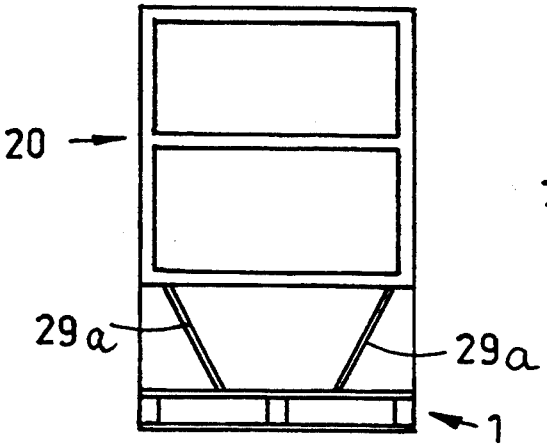
Figure 9:
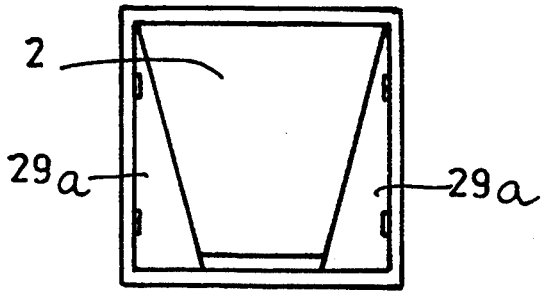
Figure 10:
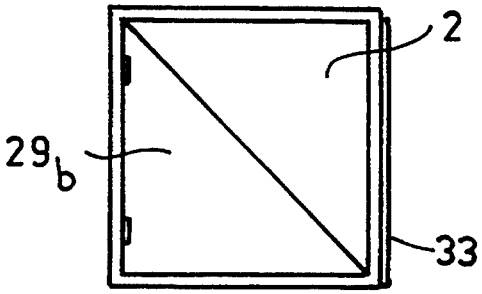
Figure 11:
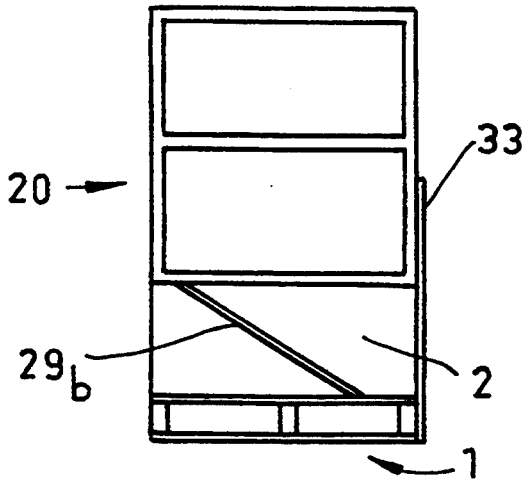
Figure 12:
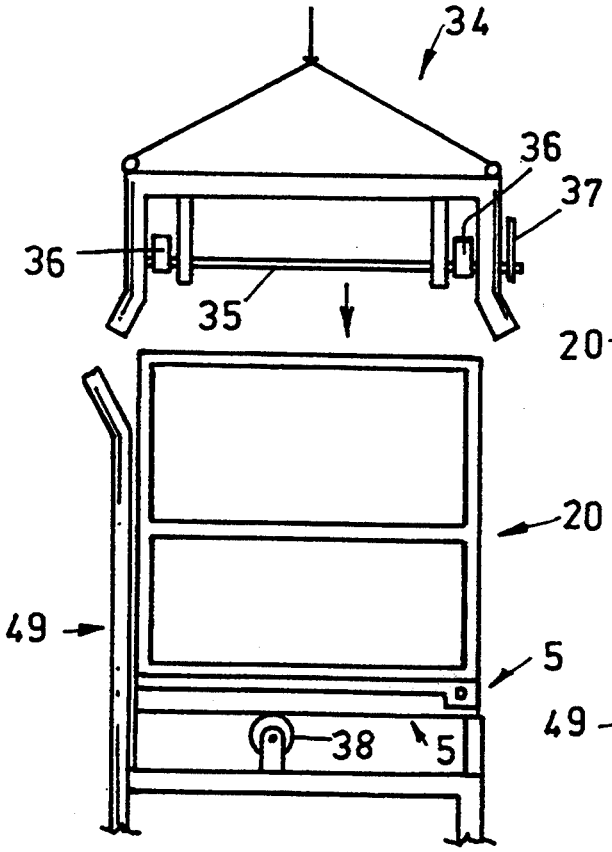
Figure 13:
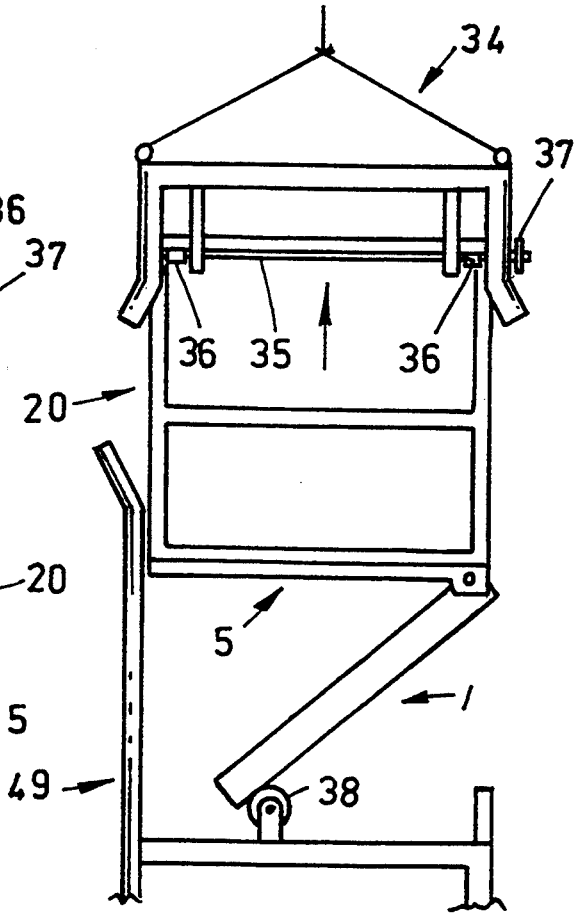
Figure 14:
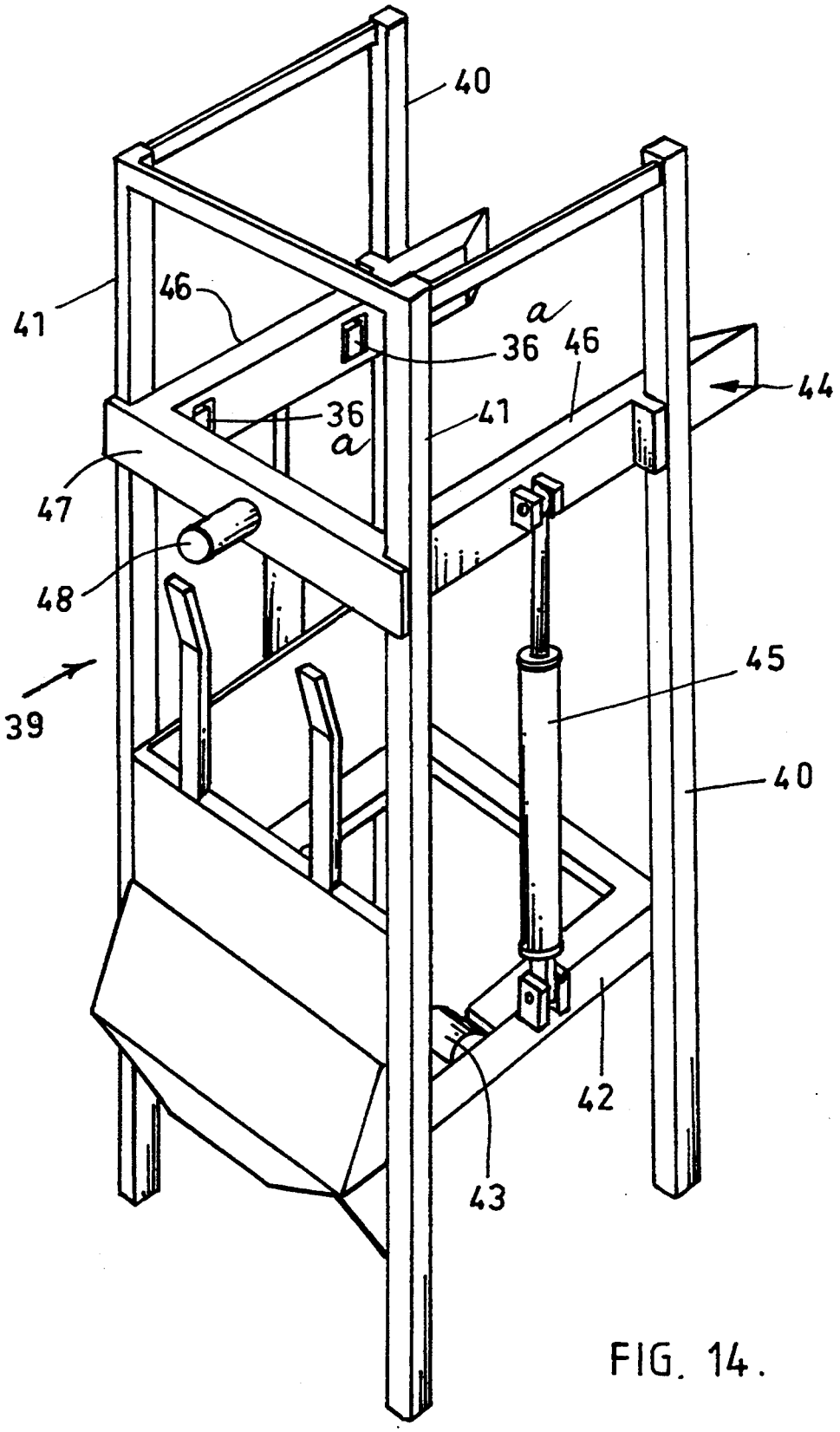

Preferred embodiments of the various features of the invention will now be described with reference to the accompanying drawings in which:

FIG. 1 is an exploded schematic perspective view of one form of a container base according to the invention with associated wall panels of an enclosure for coupling to the base, FIG. 2 is a an exploded enlarged view of another form of the container base of the invention, FIG. 3 is a fragmentary sectioned view on the section line 3—3 of FIG. 2 as it would appear when the components of the container base are secured together, FIG. 4 is a schematic side view of the base of the invention as shown in FIG. 2 with enclosure forming wall panels coupled to it to make a container and with the base closed, FIG. 5 is a view similar to FIG. 4 with the base in the open condition, FIG. 6 is a front view of the container of FIG. 4, FIG. 7 is a top view of the container of FIG. 6 showing some possible shapes for discharge flow diverter flaps, if fitted, FIG. 8 is a front view of the container of FIG. 7 showing discharge flow diverter flap positioning when the base is in the open condition, FIG. 9 is a top view of the container in the FIG. 8 condition, FIG. 10 is a top view of a container in the FIG. 4 condition showing another form of discharge flow diverter flap, FIG. 11 is a front view of a container as shown in FIG. 10 with the base bottom open showing the disposition of the discharge flow diverter flap, FIG. 12 is a schematic side elevation of a container in a device to facilitate use of the base of this invention, FIG. 13 is a view similar to FIG. 12 but with the container base in the open condition, and FIG. 14 is a is a schematic perspective view of another form of device to facilitate use of the base of this invention, As shown in FIGS. 1 and 2 the container base 1 includes a base bottom in the form of a pallet 1*a* comprising three bearings 4 and upper battens 18 covered by a cover sheet 2 and there is a hole 3 in each of the outer pallet bearers 4. The container base also includes a four sided base frame 5 defining an opening 5*a* and it is pivotally connected by pivot pins 6 to the bearers 4 of the base bottom so it can pivot with respect to the base frame 5. The base bottom can have other forms and need not be a pallet and cover sheet arrangement. FIGS. 1 and 2 show two different pallet forms, the former being a four way entry pallet and the latter a two way entry pallet.

The base frame 5 includes, in the illustrated embodiment, an inner rail 7 which is of inverted U configuration with slots 8 in the upper face 9 of the rail, which is also the bottom portion of the inverted U. Upstanding from the rail upper face 9 there is a discontinuous flange made up of sections 10*a*, 10*b*, 10*c* and 10*d*. The flange sections 10*a,b,c*, are terminated short of the corners of the rail 7 to provide gaps 11*a,b,c*, for reasons to be explained. The flange 10*d* on the fourth side of the rail 7 terminates short of both ends of the corresponding side of the rail 7 to accommodate two latch means 50 and provide a further notch 11*d*.

The latch means 50 can be best seen in FIG. 3. Each comprises a front plate 13 and a top plate 14 slideably supported on bars 15 between the legs 16 of the inverted U channels forming the rail 7. There are tension springs 17 to draw the plates 13 against the ends of the bearers 4 and the front edge of the batten 18.

The front plates 13 each have an inwardly directed lug 19 which underlies the top batten 18 and thereby prevents the base bottom pivoting relative to the base frame 5 until the latch members are withdrawn against the action of the springs 17.

The manner of use of the base is seen in FIGS. 4 and 5. These figures illustrate an enclosure 20 mounted on the base to form a container. The enclosure 20 comprises four interconnected wall panels 21 each provided with hooks 22 for hooking engagement in the slots 8 in the rail 7. The hooking engagement involves a double movement, first a vertical movement to enter the hooks 22 into the slots 8 and then a lateral movement to engage end portions of the hooks below the rail 7 at the ends of the slots 8.

The notches 11*a*, 11*b*, 11*c*, 11*d* facilitate the hooking movements and the positioning of the slots and the hooks on the wall panels is such that when the hooks are properly engaged, the ends of the wall panels will be in the abutting relationship illustrated in FIG. 1. When so arranged, coupling means at the corner of the wall panels will prevent the reverse cycle of movement thereby retaining the enclosure coupled to the container base. The upstanding flanges 10*a*, 10*b*, 10*c*, 10*d* act as lateral support members on the base frame for abutting engagement by the wall panels to relieve the wall panel hooks 22 from outwardly directed loads applied to the wall panels.

Preferably, the wall panels each comprise a frame made of tubular elements including two upright corner posts 23 connected by top, middle and bottom rails 24, 25 and 26, respectively. There is a lining panel 27 fixed to the inner faces of the frames of the wall panels. It is to be understood that wall panels of an alternate construction can be used if desired and minor features of design may need to be changed to accommodate such other constructions. It is however essential that the wall panels include or are provided with abutment surfaces for reasons to be explained later. The top rails 24 in the wall panels illustrated in FIG. 1 constitute appropriate abutment surfaces.

The panels 21 are interconnected at their respective corner posts 23 by any suitable means and in FIG. 1 releasable coupling means indicated at 28 are provided as the interconnection means.

The base as illustrated in FIG. 1 is provided with two flaps 29. The flaps have opposed parallel sides 30 and 31 with the sides 30 hingedly connected to the sides of the base frame 5 adjacent the flanges 10*a* and 10*c*. The length of the sides 30 approximates the distance between the sides 10*b* and 10*d* of the base frame 5. The sides 31 of the flaps are shorter than the sides 30 and the ends of the sides 30 and 31 are joined by angled sides 32. The design of the flap angle side 32 is such that when the base bottom is opened to a predetermined extent, the angled sides 32 will bear on cover sheet 2. The inclined surface of the cover sheet 2 and the inclined surfaces of the flaps 29 will form a three sided chute for the discharge of material from the container towards the open front of the chute, that is beneath the base frame side 10*d*. Desirably, there will be a hopper or other device, such as a delivery chute or another piece of equipment, to collect the material discharged from the container. The front elevations of FIGS. 6 and 8 show the container with the base closed and the base open as just described and FIGS. 7 and 9 are corresponding top views.

In an alternative flap form the flaps 29*a* could be as shown in full lines in FIG. 7, If a side discharge is required, a single flap 29*b* as shown in FIG. 10 can be provided; this will require a side plate 33 as part of a container support, see FIG. 11.

Means to maximise the advantages to be obtained from a container with a base as disclosed above will now be described. Several arrangements of container support are possible. There are two main arrangements which can be classified as 'top lift' and 'elevated'. In the 'top lift' arrangement the container is raised in a manner which will not interfere with the opening of the base bottom and as it is raised, the base bottom opens in a controlled manner. The container is maintained raised until empty and then lowered to cause the base bottom to close. In the 'elevated' arrangement, the container with the base bottom locked closed is supported in a raised condition by means which will not hinder the opening of the base bottom and at an elevation that will allow the base bottom to open to a predetermined extent. The base bottom latching means is then released and the base bottom is opened in a controlled manner. After the discharge of the container contents, the base bottom is closed and the container is removed from the supporting device.

Examples of one top lift arrangement is schematically shown in FIGS. 12 and 13. As illustrated the container comprised of the base 1 and an assembly of wall panels 21 is supported on a stand 49 and there is a hoist 34. The hoist has two spaced part-rotatable shafts 35 fitted with dogs 36 operable by a handle 37. The hoist 34 is lowered over the top of the container with the dogs 36 retracted and when the dogs 36 are at an elevation below the top rails 24 of the wall panels 21, the shafts 35 are rotated by the use of the handle 37. This causes the dogs 36 to extend sufficiently to engage under the top rails 24 of two opposed wall panels 21 (the rails 24 constitute abutment surfaces) as the hoist 34 is raised. As the hoist is raised, the base bottom (now released of the latching restraint which secures it to the base frame) will open and this is achieved in a controlled manner by means of a supporting roller 38, see FIG. 13.

In another top lift arrangement as illustrated in FIG. 14, there is a support frame 39 including posts, a pair of posts 40 and a pair 41 joined adjacent the bottoms by a sub-frame 42 which includes rollers 43 which are the equivalent of the roller 38 of the arrangement of FIGS. 12 and 13. There is a raiseable U shaped arm 44 slideably supported on the post pairs 40,41 and there are two lifting cylinders 45 to raise and lower the U shaped arm 44. Within the limbs 46 of the arm 44 there are shafts (not shown but the equivalent of the shafts 35 of FIGS. 12 and 13) and each arm 44 carries dogs 36*a* of the type and for the same purpose as the dogs 36 of FIGS. 12 and 13.

In the connecting limb 47 of the arm 44 there is a drive shaft geared to the shafts within the limbs 46. The drive shaft has a lever arm (also within the connecting limb 47) connected to the piston rod of a piston in the cylinder 48. Movement of the piston in the cylinder 48 in one direction by a driving fluid (e.g.compressed air) will cause the drive shaft to rotate and the interconnected driven shafts to rotate and the dogs 36*a* to move between retracted and extended positions. The supply of driving fluid to the cylinder 48 can be controlled by, for example, a valve operated by the arm 44. The valve is held depressed when the arm 44 is in a position to receive a container. In that position the dogs 36 will be located below the abutment surfaces of the container, i.e. the top rails 24, sufficiently to allow the dogs 36*a* to extend as the arm 44 commences to rise to release the valve to direct fluid to the cylinder 48. Likewise, in a lowering operation the dogs will be retracted when the valve is operated by the lowering arm to cause the dogs 36*a* to retract. This will allow the container to be removed by a fork lift truck.

During the raising of the container by the arm 44 through the dogs 36*a*, the base bottom will be supported on the rollers 43; the functioning of this device is similar to that of the device shown in FIGS. 12 and 13.

In the 'elevated' arrangement referred to above, the container with base closed would be mounted on an elevated support, as by a fork lift truck, in a manner which would not interfere with the opening of the base bottom. The latch for the base bottom would be released while the base bottom was supported, as by the fork lift truck. The base bottom would then be lowered until it engages an abutment which would limit the extent to which the base bottom could be opened. The forks of the fork lift truck could be provided with a suitable support, for example one incorporating rollers or moving belts or very low friction surfaces for engagement by the front edge of the base bottom as it is lowered. After assisting with the opening of the base bottom, the fork lift truck can used for other purposes until the empty container has to be removed from its support. At this time the reverse procedure to that outlined above would be adopted.

It is to be understood that the above examples of 'top lift' and 'elevated' arrangements for the discharge of the contents of a container having the base of the present invention have been described in principal. There are various ways of constructing the devices for handling top lift and elevated discharge from containers fitted with the base of the invention without departing from the inventive concepts herein disclosed.

By way of example, changes can be made to the means for actuating the fingers 36. In an alternative arrangement the cylinder 48 can be replaced by a mechanical means, such as a plunger activated by the placement of the container in the U shaped arm 44.

I claim:

1. A container base, comprising:

a four-sided rectangular ring frame with each side of said four-sided rectangular ring frame having an inner face, said inner faces of the four sides of said ring frame defining an opening through said ring frame;

four separate interconnectable wall panels;

coupling means having first elements on each of the four sides of said ring frame for engagement by second elements of said coupling means, said second elements being on each of said four separate interconnectable wall panels;

a base bottom larger in size than the opening through said ring frame;

a hinge connection connecting said base bottom to a first side of said ring frame; and latch means for releasably retaining said base bottom in a covering relationship with the opening through said ring frame.

2. The container base as claimed in claim 1, further including apertures for engagement by lifting arms of a base lifting device.

3. The container base as claimed in claim 1, further comprising a support member on each of said sides of said ring frame positioned outboard of said first elements of said coupling means for abutting engagement by the separate interconnectable wail panels when mounted on the base for relieving said coupling means from outwardly directed loads applied to said separate interconnectable wall panels.

4. The container base as claimed in claim 1, further comprising two similarly-shaped flaps, each flap having an outer edge, an inner edge and first end edge and a second end edge, hinge means connecting the outer edge of each of said flaps, respectively, to oppositely positioned second and third sides of said ring frame, lengths of the outer edge of each of said flaps being substantially equal to, but less than, the distance between the inner faces of the oppositely positioned first side and fourth side of said ring frame, the inner edge of each of said flaps being shorter than the outer edge of each of said flaps, said flaps when extending across the opening through said ring frame not overlapping and having the first end edges of both of said flaps adjacent and substantially parallel to the inner face of the fourth side of said ring frame and the second end edges of said flaps being angled to the inner face of the first side of said ring frame, the angle of the second end edges of said flaps being such that for a predetermined angular opening of said base bottom relative to said ring frame, the end edges of said flaps, being angled, will bear on said base bottom.

5. The container base as claimed in claim 1, further comprising two similarly-shaped flaps, each of said flaps being of substantially right angle triangular shape with a first edge, a base edge and a hypotenuse, hinge means connecting the first edges of said two flaps, respectively, to oppositely positioned second and third sides of said ring frame, the length of said first edge of each of said flaps being substantially equal to, but less than, the distance between the inner faces of the oppositely positioned first side and fourth side of said base, said flaps when extending across the opening through said ring frame not overlapping and having their base edges adjacent and substantially parallel to the inner face of the fourth said of said ring frame.

6. The container base as claimed in claim 1, further comprising a flap having a substantially right angle triangular shape with a first edge, a base edge and a hypotenuse, hinge means connecting the first edge of said flap to a second side of said base adjacent the first side of said base, the length of the first edge of said flap being substantially equal to, but less than, the distance between the inner faces of oppositely positioned first and fourth side of said base, said flap, when extending across the opening through the ring frame, having the base edge of said flap adjacent and substantially parallel to the inner face of the fourth side of said ring frame.

* * * * *